US012680170B2

(12) United States Patent
II et al.

(10) Patent No.: US 12,680,170 B2
(45) Date of Patent: Jul. 14, 2026

(54) ELECTROLESS RUTHENIUM PLATING BATH

(71) Applicant: C. Uyemura & Co., Ltd., Osaka (JP)

(72) Inventors: Yoshihito II, Osaka (JP); Yoichi Maruo, Osaka (JP); Yukinori Oda, Jurong (SG)

(73) Assignee: C. UYEMURA & CO., LTD., Osaka (JP)

( * ) Notice: Subject to any disclaimer, the term of this patent is extended or adjusted under 35 U.S.C. 154(b) by 452 days.

(21) Appl. No.: 18/538,789

(22) Filed: Dec. 13, 2023

(65) Prior Publication Data

US 2024/0218518 A1 Jul. 4, 2024

(30) Foreign Application Priority Data

Dec. 28, 2022 (JP) ..... 2022-211566

(51) Int. Cl.
*C23C 18/44* (2006.01)

(52) U.S. Cl.
CPC ..... *C23C 18/44* (2013.01)

(58) Field of Classification Search
CPC ..... C23C 18/31; C23C 18/42; C23C 18/44; C23C 18/52
See application file for complete search history.

(56) References Cited

U.S. PATENT DOCUMENTS

| | | | | |
|---|---|---|---|---|
| 7,682,431 | B1 * | 3/2010 | Zieliene | C23C 18/44 106/1.24 |
| 8,124,174 | B2 * | 2/2012 | Kurosaka | H05K 3/244 427/125 |
| 2008/0277140 | A1 | 11/2008 | Kurosaka et al. | |

FOREIGN PATENT DOCUMENTS

| | | | |
|---|---|---|---|
| JP | S5847471 | B2 * | 10/1983 |
| JP | S5934784 | B2 * | 8/1984 |
| JP | S 61-039235 | A | 2/1986 |
| JP | 2008-266668 | A | 11/2008 |
| JP | 2012-508819 | A | 4/2012 |

OTHER PUBLICATIONS

Y.S. Chang, M.L. Chou, "*Microstructure evolution of newly developed electroless ruthenium deposition on silicon observed by scanning transmission electron microscope*," Journal of Applied Physics, vol. 69, 78481-7852 (Jun. 1, 1991).

* cited by examiner

*Primary Examiner* — Gerard Higgins
(74) *Attorney, Agent, or Firm* — Buchalter LLP

(57) ABSTRACT

An electroless ruthenium plating bath at least contains: a ruthenium compound; a reducing agent; and a stabilizer. The reducing agent is at least one of an amine borane compound or sodium hypophosphite. The stabilizer is made of a hydroxylamine compound and an amine compound. The hydroxylamine compound is at least one of hydroxylamine sulfate or hydroxylamine chloride.

6 Claims, No Drawings

ELECTROLESS RUTHENIUM PLATING BATH

CROSS-REFERENCE TO RELATED APPLICATION

This application claims priority to Japanese Patent Application No. 2022-211566 filed on Dec. 28, 2022, the entire disclosure of which is incorporated by reference herein.

BACKGROUND

The present disclosure relates to an electroless ruthenium plating bath.

Copper has high electrical conductivity, and is excellent in physical properties such as connectivity in thermocompression bonding, and in chemical properties such as oxidation resistance and chemical resistance. Thus, copper is widely used in wiring of circuits on printed wiring boards, mounting portions and terminal portions of IC packages, and the like in the field of the electronics industry.

Further, along with the miniaturization of semiconductor circuits, the miniaturization of copper wiring is also conducted. With such miniaturization, the density of current flowing in the copper wiring increases. This causes a problem that voids are generated due to electromigration (a phenomenon in which copper atoms move due to a high-density current flowing through the copper wiring) and disconnection occurs.

Therefore, ruthenium has recently attracted attention as a next-generation wiring material in place of copper. Ruthenium is a material having a higher capacity of allowing current density and a higher electromigration resistance than copper. Ruthenium is therefore expected as, in addition to the wiring of semiconductor circuits mentioned above, a material for a thin film (cap metal) formed on the copper wiring and a material for a liner film formed on a barrier metal so that a copper seed film grow uniformly in forming a copper wiring film by electroplating.

If it becomes possible to use the electroless ruthenium plating process in forming wiring and the like of semiconductor circuits, ruthenium can be selectively deposited only by immersion without any external power source. Thus, a ruthenium-containing electroless plating bath has been proposed.

For example, an electroless ruthenium plating bath containing a ruthenium source, polyaminopolycarboxylic acid as a complexing agent, sodium borohydroxide ($NaBH_4$) as a reducing agent, and hydroxylamine sulfate as a stabilizer has been proposed (e.g., see Japanese Unexamined Patent Publication No. 2012-508819).

SUMMARY

Since ruthenium has a plurality of valences, it is difficult to be deposited as a metal and has a poor deposition property.

Although sodium borohydroxide is used as a reducing agent in known plating baths, sodium borohydroxide has a problem of difficulty in handling because it has high reactivity and tends to cause bath decomposition and deposition in a pattern other than the desired pattern, and the like.

In view of the above problems, the present disclosure is intended to provide an electroless ruthenium plating bath using, as a commonly used reducing agent, an amine borane compound or sodium hypophosphite, capable of improving bath stability and having an excellent ruthenium deposition property.

In order to achieve the above objective, an electroless ruthenium plating bath according to the present disclosure at least contains: a ruthenium compound; a reducing agent; and a stabilizer. The reducing agent is at least one of an amine borane compound or sodium hypophosphite. The stabilizer is made of a hydroxylamine compound and an amine compound. The hydroxylamine compound is at least one of hydroxylamine sulfate or hydroxylamine chloride.

The present disclosure can improve bath stability and a ruthenium deposition property in the electroless ruthenium plating bath using an amine borane compound or sodium hypophosphite, which is a commonly used reducing agent.

DETAILED DESCRIPTION

An electroless ruthenium plating bath according to the present disclosure will be described below.

<Electroless Ruthenium Plating Bath>

The electroless ruthenium plating bath according to the present disclosure at least contains a ruthenium compound, a reducing agent, and a stabilizer.

(Ruthenium Compound)

The ruthenium compound is a ruthenium ion source for ruthenium plating. The ruthenium compound only needs to be water-soluble, and examples thereof include inorganic water-soluble ruthenium salts such as ruthenium chloride, ruthenium sulfate, and ruthenium nitrate. These ruthenium compounds may be used alone, or two or more kinds may be used in a mixture.

Ruthenium has a plurality of valences, and the amount of ruthenium deposited in the plating bath varies depending on the valence of ruthenium. In light of ensuring the stability of the plating bath, ruthenium is preferably trivalence or tetravalence.

Accordingly, as the ruthenium compound, for example, ruthenium(III) chloride or ruthenium(III) nitrate made of trivalent ruthenium, ruthenium(IV) chloride or ruthenium (IV) sulfate made of tetravalent ruthenium, or the like is preferably used.

In the electroless ruthenium plating bath, the concentration of ruthenium ions is not particularly limited, but is preferably more than 0.01 g/L, more preferably 1 g/L or more because a too low concentration of ruthenium ions may significantly lower the deposition rate at which the plating film is deposited. The concentration is preferably 20 g/L or less, more preferably 10 g/L or less because a too high concentration of ruthenium ions may cause bath decomposition due to excessive reaction.

The concentration of ruthenium ions can be measured by atomic absorption spectrometry (AAS) using an atomic absorption spectrophotometer.

(Reducing Agent)

The reducing agent has a function of depositing ruthenium in the electroless ruthenium plating bath. The reducing agent used in the electroless ruthenium plating bath according to the present disclosure is at least one of an amine borane compound or sodium hypophosphite.

Examples of the amine borane compound include dimethylamine borane (DMAB), trimethylamine borane (TMAB), morpholine borane, picoline borane, pyridine borane, diethylaniline borane, and in light of large amount of circulation and easy availability, the amine borane compound is particularly preferably dimethylamine borane, trimethylamine borane, or morpholine borane. The amine borane compounds may be used alone, or two or more kinds may be used in a mixture.

The content of the reducing agent in the electroless ruthenium plating bath is preferably 0.2 g/L or more, more preferably 1 g/L or more because a too low concentration of the reducing agent may significantly lower the deposition rate of the plating film. The content is preferably 30 g/L or less, more preferably 15 g/L or less because a too high concentration of the reducing agent may cause bath decomposition due to excessive reaction.

(Stabilizer)

The stabilizer has a main function as a complexing agent that stabilizes solubility of ruthenium in the electroless ruthenium plating bath. The stabilizer used in the electroless ruthenium plating bath according to the present disclosure is a combination of a hydroxylamine compound and an amine compound.

The hydroxylamine compound forms a metal complex with ruthenium ions in the electroless ruthenium plating bath, thereby contributing to bath stability. Examples of the hydroxylamine compound include, but are not limited to, hydroxylamine sulfate and hydroxylamine chloride. The hydroxylamine compounds may be used alone, or two or more kinds may be used in a mixture.

The content of the hydroxylamine compound in the electroless ruthenium plating bath is preferably 1 g/L or more, more preferably 2 g/L or more because a too low concentration of the hydroxylamine compound may lower bath stability, thereby causing bath decomposition. The content is preferably 10 g/L or less, more preferably 8 g/L or less because a too high concentration of the hydroxylamine compound may cause excessive bath stability, thereby lowering a ruthenium deposition property.

The amine compound has a function as a second complexing agent when used in combination with the above-described hydroxylamine compound in the electroless ruthenium plating bath and forms a metal complex with ruthenium ions, thereby contributing to bath stability. Examples of the amine compound include, but are not limited to, amino acids such as glycine, glycylglycine, sodium aspartate, sodium glutamate, aspartic acid, glutamic acid, iminobisacetic acid, L-arginine, alanine, ß-alanine, serine, threonine, tyrosine, asparagine, glutamine, lysine, leucine, isoleucine, lysine, tryptophan, valine, histidine, and arginine, taurine, and ethylene diamine. The amine compound is particularly preferably glycine, glycylglycine, sodium aspartate, sodium glutamate, L-arginine, β-alanine, serine, threonine, tyrosine, asparagine, glutamine, or lysine. The amine compounds may be used alone, or two or more kinds may be used in a mixture.

The content of the amine compound in the electroless ruthenium plating bath is preferably 1 g/L or more, more preferably 2 g/L or more because a too low concentration of the amine compound may lower bath stability, thereby causing bath decomposition. The content is preferably 15 g/L or less, more preferably 10 g/L or less because a too high concentration of the amine compound causes excessive bath stability, thereby lowering a ruthenium deposition property.

The hydroxylamine compound contributes more to bath stability than the amine compound. Thus, using only the hydroxylamine compound as a stabilizer may result in excessive bath stability, thereby reducing ruthenium deposition property. In light of this fact, in the electroless ruthenium plating bath according to the present disclosure, the hydroxylamine compound and the amine compound that contributes less to bath stability than the hydroxylamine compound are used in combination as a stabilizer. Thus, the electroless ruthenium plating bath using, as a commonly used reducing agent, an amine borane compound or sodium hypophosphite has improved bath stability (i.e. prevents excessive bath stability) and has an excellent deposition property.

In particular, the electroless ruthenium plating bath has an excellent deposition property, even in a fine portion where a plating reaction is less likely to occur (e.g., a portion to be plated having a plating area of several tens of nanosquare meter level).

(Deposition Rate Adjuster)

A deposition rate adjuster is added in order to smoothly remove an underlayer oxide or the like and has a function of improving the ruthenium deposition rate.

As the deposition rate adjuster, various chelating agents can be used, and examples thereof include ethylene diamine tetraacetic acid (EDTA), nitrilotriacetic acid (NTA), diethylene triamine pentaacetic acid (DTPA), hydroxyethyl ethylene diamine triacetic acid (HEDTA), triethylene tetramine hexaacetic acid (TTHA), trans-1,2-diaminocyclohexane-N,N,N',N'-tetraacetic acid (CyDTA), nitrogen-containing phosphorus compounds such as ethylene diamine tetra methylene phosphonic acid (EDTMP), citric acid, malic acid, gluconic acid, lactic acid, malonic acid, and fumaric acid. The deposition rate adjusters may be used alone, or two or more kinds may be used in a mixture.

The content of the deposition rate adjuster in the electroless ruthenium plating bath is preferably 1 g/L or more, more preferably 2 g/L or more because a too low concentration of the deposition rate adjuster may lower a ruthenium deposition rate, thereby increasing a plating process time. The content is preferably 60 g/L or less, more preferably 20 g/L or less because a too high concentration of the deposition rate adjuster causes an increase in cost due to excessive addition.

(Other Components)

In the electroless ruthenium plating bath according to the present disclosure, various additives commonly used in the field of plating bath can be added in addition to the components described above. Examples of such additives include, but are not limited to, deposition rate controlling agent for controlling the ruthenium deposition rate (fine adjustment of the ruthenium deposition rate).

Examples of the deposition rate controlling agents include unsaturated carboxylic acids such as maleic acid, 1,4-butynediol, and itaconic acid. The deposition rate controlling agents may be used alone, or two or more kinds may be used in a mixture.

(pH)

The pH of the electroless ruthenium plating bath according to the present disclosure is preferably 10 to 14, more preferably 11 to 14, yet more preferably 12 to 14. If the pH is less than 10, the deposition of ruthenium may be insufficient, and if the pH is more than 14, a ruthenium salt may be generated and deposited.

The pH of the plating bath can be adjusted by a pH adjuster such as sodium hydroxide, potassium hydroxide, ammonia water, tetramethyl ammonium hydroxide, sulfuric acid, hydrochloric acid, citric acid, boric acid, phosphoric acid, monocarboxylic acid, and dicarboxylic acid. The pH adjusters may be used alone or, two or more kinds may be used in a mixture.

(Temperature of Plating Bath)

The temperature of the plating bath is not particularly limited, and is preferably 60° C. to 90° C., more preferably 65° C. to 90° C., yet more preferably 70° C. to 85° C. If the temperature of the plating solution is less than 60° C., the plating solution may be inactivated to cause insufficient deposition of ruthenium. If the temperature exceeds 90° C., the bath may be excessively activated to cause bath decomposition.

(Object to be Plated)

The electroless ruthenium plating bath of the present disclosure is applicable to any kinds of objects to be plated without particular limitations, and is applicable to objects which have been subjected to known ruthenium plating (for example, wiring in circuits on printed circuit boards, mounting portions and terminal portions of IC packages, and the like).

The electroless ruthenium plating bath according to the present disclosure is particularly suitably used when a wiring portion of a semiconductor circuit, a thin film (cap metal) formed on the copper wiring, or a liner film that is formed, in forming a copper wiring film by electroplating, on a barrier metal so that a copper seed film grow uniformly, is formed of ruthenium.

(Electroless Ruthenium Plating Process)

The object to be plated is brought into contact with the electroless ruthenium plating bath according to the present disclosure to be subjected to electroless ruthenium plating process, thereby forming a ruthenium plating film constituting the wiring portion, thin film (cap metal), or liner film. The temperature during the electroless ruthenium plating process is controlled to the bath temperature of the electroless ruthenium plating bath.

A process time of the electroless ruthenium plating process is not particularly limited and may be set as appropriate to attain a desired film thickness. More specifically, the process time may be, for example in a range of 30 seconds to 15 hours, approximately. The film thickness of the ruthenium plating film may be set as appropriate in accordance with required characteristics, and usually ranges from about 0.001 μm to about 1.0 μm.

EXAMPLES

The following describes the present disclosure more specifically based on examples and comparative examples. However, the present disclosure is not limited to the following examples at all.

Examples 1 to 48 and Comparative Examples 1 to 17

(Preparation of Plating Bath)

To 200 ml of deionized water, a ruthenium compound (ruthenium salt), a hydroxylamine compound and an amine compound in combination as a stabilizer, a reducing agent, a deposition rate adjuster, a pH adjuster, and a deposition rate controlling agent were added and mixed in concentrations shown in Tables 2 to 8. The mixture was agitated, thereby preparing plating baths of Examples 1 to 48 and Comparative Examples 1 to 17.

As shown in Tables 2 to 8, the temperature of each of the plating baths (the temperature during plating process) was set to 50° ° C. to 90° C., and the pH of the same was set to 10 to 14.

(Pretreatments)

Prior to the electroless plating process, pretreatments 1 and 2 shown in Table 1 were performed on a substrate in order. Washing with deionized water was performed between the pretreatments.

Pretreatment 1: A substrate (a Si wafer with a ruthenium thin film (5 nm) applied as an underlayer by CVD) was degreased and cleaned using MCL-12 (trade name: EPITHAS (registered trademark) MCL-12, manufactured by C. Uyemura & Co., Ltd.).

Pretreatment 2: Subsequently, the surface of the substrate was activated using MRU-30 (trade name: EPITHAS (registered trademark) MRU-30, manufactured by C. Uyemura & Co., Ltd.).

TABLE 1

| | | | Processing Solution | Processing Temperature | Process Time (min) |
|---|---|---|---|---|---|
| Pretreatment | 1 | Degreasing Cleaning | MCL-12 | 40° C. | 3 |
| | 2 | Activation | MRU-30 | 60° C. | 10 |

(Electroless Ruthenium Plating Process)

Then, the substrate which had been subjected to the pretreatments was immersed in one of the plating baths of Examples 1 to 48 and Comparative Examples 1 to 17 shown in Tables 2 to 8 for 10 minutes. Thus, a ruthenium plating film was formed on the surface of the substrate (on the ruthenium thin film).

(Calculation of Film Thickness of Ruthenium Plating Film Formed and Calculation of Ruthenium Deposition Rate)

Next, the film thickness [nm] of the ruthenium plating film formed on the surface of the substrate was calculated using an X-ray fluorescence coating thickness gauge (trade name: XDV-μ manufactured by FISCHER INSTRUMENTS K.K.).

More specifically, the film thickness [nm] of the ruthenium plating film on the substrate was measured using a X-ray fluorescence coating thickness gauge, and a value obtained by subtracting the film thickness (5 nm) of the ruthenium thin film provided as the underlayer on the substrate from the measured film thickness was defined as the film thickness [nm] of the ruthenium plating film formed.

In addition, using the calculated film thickness of the ruthenium plating film, the ruthenium deposition rate [nm/10 min] in the plating process for 10 minutes was calculated. The results are shown in Tables 2 to 8.

(Evaluation of Ruthenium Deposition Property)

The appearance of the substrate which had been subjected to the electroless ruthenium plating process was visually observed, and a ruthenium deposition property of the ruthenium plating formed by the electroless ruthenium plating process was evaluated according to the following criteria. The results are shown in Tables 2 to 8.

Ruthenium was uniformly deposited on the substrate: ◎

Ruthenium was almost uniformly deposited on the substrate although slight unevenness in color tone was observed on the substrate: ○

Part of the substrate was found to have no ruthenium deposited: Δ

Ruthenium was not deposited on the substrate: x (Evaluation of Stability of Plating Bath)

Whether or not ruthenium particles were deposited in the ruthenium plating bath after the electroless ruthenium plating process was observed, and stability of the plating bath was evaluated according to the following criteria. The results are shown in Tables 2 to 8.

Even after three hours from the plating process, no deposition of ruthenium particles was observed: ◎

After three hours from the plating process, a trace amount of ruthenium particles generated was observed: ○

After three hours from the plating process, a small amount of ruthenium particles generated was observed: Δ

After three hours from the plating process, a large amount of ruthenium particles generated was observed: x (Measurement of Resistivity of Ruthenium Plating Film after Annealing)

The substrate which had been subjected to the electroless ruthenium plating process was annealed at 400° C. for 10 minutes in a formic acid atmosphere using reducing reflow equipment (trade name: VSS-300-EP, manufactured by Unitemp).

Then, the sheet resistance of the ruthenium film after the annealing was measured using a four point probe instrument (trade name: NAPSON RT-70V, manufactured by NAPSON), and based on the sheet resistance and the film thickness of the ruthenium plating film measured by the X-ray fluorescence coating thickness gauge, the resistivity [μΩcm] of the ruthenium plating film after the annealing was calculated using the following equation (1). The results are shown in Tables 2 to 8.

[Equation 1]

$$\text{Resistivity of ruthenium plating film } [\mu\Omega\text{cm}] = (\text{Sheet resistance } [\Omega/\square] \times \text{Film thickness } [\text{nm}])/10 \quad (1)$$

The resistivity of a pure ruthenium plating film is about 7.6 [μΩcm]. Thus, if the resistivity after the annealing is 10 [μΩcm] to 60 [μΩcm], it is considered that almost no boron (derived from the amine borane compound, which is a reducing agent) is co-deposited on the ruthenium plating film formed on the surface of the substrate, and it can be said that a low resistance equivalent to that of the pure ruthenium plating film is realized.

In Comparative Examples 1 and 2 and 5 to 17, ruthenium was not deposited on the surface of the substrate. Thus, the resistivity of the ruthenium film after the annealing could not be measured.

TABLE 2

| | | | Plating Bath Composition Examples | | | | | | | | | | |
|---|---|---|---|---|---|---|---|---|---|---|---|---|---|
| | | | 1 | 2 | 3 | 4 | 5 | 6 | 7 | 8 | 9 | 10 | 11 |
| Ruthenium Salt | Ruthenium(IV) Chloride (as Ruthenium) | g/L | 1 | 10 | | | | 1 | 1 | 1 | 1 | 1 | 1 |
| | Ruthenium(IV) Sulfate (as Ruthenium) | g/L | | | 2 | | | | | | | | |
| | Ruthenium(III) Nitrate (as Ruthenium) | g/L | | | | 1 | | | | | | | |
| | Ruthenium(III) Chloride (as Ruthenium) | g/L | | | | | 1 | | | | | | |
| Hydroxylamine Compound | Hydroxylamine Sulfate | g/L | 5 | 5 | 5 | 5 | 5 | 10 | | 5 | 5 | 5 | 5 |
| | Hydroxylamine Chloride | g/L | | | | | | | 5 | | | | |
| Amine Compound | Glycine | g/L | | | | | 2.5 | | | | | | |
| | Glycylglycine | g/L | 2.5 | | | | | | | 1 | | | |
| | Na Aspartate | g/L | | 2.5 | | | | 2.5 | | | 2.5 | | |
| | Na Glutamate | g/L | | | | | | | | | | 10 | |
| | L-arginine | g/L | | | 2.5 | | | | | | | | 15 |
| | β-alanine | g/L | | | | 2.5 | | | 2.5 | | | | |
| Deposition Rate Adjuster | DTPA-5H | g/L | | | | | | | | | | | |
| | NTA-3H | g/L | 5 | | | | | | | | | | |
| | TTHA-6H | g/L | | 5 | | | | | | 5 | | | |
| | HEDTA-3H | g/L | | | | | | 5 | | | 5 | | |
| | CyDTA-4H | g/L | | | 5 | | | | | | | 5 | |
| | EDTA-4H | g/L | | | | 5 | | | | | | | 5 |
| | EDTMP-8H | g/L | | | | | 5 | | 5 | | | | |
| Reducing Agent | Dimethylamine Borane | g/L | 1 | 1 | 1 | 1 | 1 | 1 | 1 | 1 | 1 | 1 | 1 |
| | Trimethylamine Borane | g/L | | | | | | | | | | | |
| | Morpholine Borane | g/L | | | | | | | | | | | |
| | Sodium Hypophosphite | g/L | | | | | | | | | | | |
| pH Adjuster | Sodium Hydroxide | g/L | | | | | | | | | | | |
| | Potassium Hydroxide | g/L | | | | | | | | | | | |
| | Tetramethyl Ammonium Hydroxide Solution (25%) | mL/L | 170 | 170 | 170 | 170 | 170 | 170 | 170 | 170 | 170 | 170 | 170 |
| Deposition Rate Controlling Agent | Maleic Acid | g/L | | 5 | 5 | | 5 | 5 | 5 | 5 | | 5 | |
| | 1,4-butynediol | ppm | | | | | | | | | | | |
| | Itaconic Acid | g/L | 5 | | | 5 | | | | | 5 | | 5 |
| | pH | | 13.3 | 13.3 | 13.3 | 13.3 | 13.3 | 13.3 | 13.3 | 13.3 | 13.3 | 13.3 | 13.3 |
| | Processing Temperature | | 80 | 80 | 80 | 80 | 80 | 80 | 80 | 80 | 80 | 80 | 80 |
| Evaluation | Film Thickness of Plating Film | nm | 98.3 | 80.3 | 44 | 25 | 98.1 | 21.1 | 68.4 | 83.5 | 78.5 | 63.2 | 54.3 |
| | Ruthenium Deposition Rate | nm/10 min | 98.3 | 80.3 | 44 | 25 | 98.1 | 21.1 | 68.4 | 83.5 | 78.5 | 63.2 | 54.3 |
| | Ruthenium Deposition Property | | ◎ | ◎ | ◎ | ◎ | ◎ | ◎ | ◎ | ◎ | ◎ | ◎ | ◎ |
| | Stability of Plating Bath | | ◎ | ◎ | ◎ | ◎ | ◎ | ◎ | ◎ | ◎ | ◎ | ◎ | ◎ |
| | Resistivity of Plating Film after Annealing | μΩcm | 23.5 | 20.3 | 20.5 | 21.2 | 22.1 | 26.2 | 20.1 | 22.1 | 22.4 | 24.5 | 21.1 |

TABLE 3

| | | | Plating Bath Composition Examples | | | | | |
|---|---|---|---|---|---|---|---|---|
| | | | 12 | 13 | 14 | 15 | 16 | 17 |
| Ruthenium Salt | Ruthenium(IV) Chloride (as Ruthenium) | g/L | 1 | 1 | 1 | 1 | 1 | 1 |
| | Ruthenium(IV) Sulfate (as Ruthenium) | g/L | | | | | | |
| | Ruthenium(III) Nitrate (as Ruthenium) | g/L | | | | | | |
| | Ruthenium(III) Chloride (as Ruthenium) | g/L | | | | | | |
| Hydroxylamine Compound | Hydroxylamine Sulfate | g/L | 5 | 5 | 5 | 5 | 5 | 5 |
| | Hydroxylamine Chloride | g/L | | | | | | |
| Amine Compound | Serine | g/L | 2.5 | | | | | |
| | Threonine | g/L | | 2.5 | | | | |
| | Tyrosine | g/L | | | 2.5 | | | |
| | Asparagine | g/L | | | | 2.5 | | |
| | Glutamine | g/L | | | | | 2.5 | |
| | Lysine | g/L | | | | | | 2.5 |
| Deposition Rate Adjuster | DTPA-5H | g/L | 5 | | | | | |
| | NTA-3H | g/L | | 5 | | | | |
| | TTHA-6H | g/L | | | 5 | | | |
| | HEDTA-3H | g/L | | | | 5 | | |
| | CyDTA-4H | g/L | | | | | 5 | |
| | EDTA-4H | g/L | | | | | | 5 |
| | EDTMP-8H | g/L | | | | | | |
| Reducing Agent | Dimethylamine Borane | g/L | 1 | 1 | 1 | 1 | 1 | 1 |
| | Trimethylamine Borane | g/L | | | | | | |
| | Morpholine Borane | g/L | | | | | | |
| | Sodium Hypophosphite | g/L | | | | | | |
| pH Adjuster | Sodium Hydroxide | g/L | | | | | | |
| | Potassium Hydroxide | g/L | | | | | | |
| | Tetramethyl Ammonium Hydroxide Solution (25%) | mL/L | 170 | 170 | 170 | 170 | 170 | 170 |
| Deposition Rate Controlling Agent | Maleic Acid | g/L | 5 | | 5 | | 5 | |
| | 1,4-butynediol | ppm | | | | | | |
| | Itaconic Acid | g/L | | 5 | | 5 | | 5 |
| | pH | | 13.3 | 13.3 | 13.3 | 13.3 | 13.3 | 13.3 |
| | Processing Temperature | | 80 | 80 | 80 | 80 | 80 | 80 |
| Evaluation | Film Thickness of Plating Film | nm | 63.2 | 72.1 | 75.3 | 80.2 | 78.1 | 82.3 |
| | Ruthenium Deposition Rate | nm/10 min | 63.2 | 72.1 | 75.3 | 80.2 | 78.1 | 82.3 |
| | Ruthenium Deposition Property | | ◎ | ◎ | ◎ | ◎ | ◎ | ◎ |
| | Stability of Plating Bath | | ◎ | ◎ | ◎ | ◎ | ◎ | ◎ |
| | Resistivity of Plating Film after Annealing | μΩcm | 23.1 | 21.5 | 22.5 | 24.3 | 21.1 | 24.5 |

TABLE 4

| | | | Plating Bath Composition Examples | | | | | | | | | | | |
|---|---|---|---|---|---|---|---|---|---|---|---|---|---|---|
| | | | 18 | 19 | 20 | 21 | 22 | 23 | 24 | 25 | 26 | 27 | 28 | 29 |
| Ruthenium Salt | Ruthenium(IV) Chloride (as Ruthenium) | g/L | 1 | 1 | 1 | 1 | 1 | 1 | 1 | 1 | 1 | 1 | 1 | 1 |
| | Ruthenium(IV) Sulfate (as Ruthenium) | g/L | | | | | | | | | | | | |
| | Ruthenium(III) Nitrate (as Ruthenium) | g/L | | | | | | | | | | | | |
| | Ruthenium(III) Chloride (as Ruthenium) | g/L | | | | | | | | | | | | |
| Hydroxylamine Compound | Hydroxylamine Sulfate | g/L | 5 | 5 | 5 | 5 | 5 | 5 | 5 | 5 | 5 | 5 | 5 | 5 |
| | Hydroxylamine Chloride | g/L | | | | | | | | | | | | |
| Amine Compound | Glycine | g/L | 2.5 | | | | | | | | | | | 2.5 |
| | Glycylglycine | g/L | | 2.5 | | | | | | 2.5 | | | | |
| | Na Aspartate | g/L | | | 2.5 | | | | | | 2.5 | | | |
| | Na Glutamate | g/L | | | | 2.5 | | | | | | 2.5 | | |
| | L-arginine | g/L | | | | | 2.5 | | 2.5 | | | | | |
| | β-alanine | g/L | | | | | | 2.5 | | | | | 2.5 | |
| Deposition Rate Adjuster | DTPA-5H | g/L | | | | | | | | | | | | |
| | NTA-3H | g/L | | 1 | | | | | | 5 | | | | |
| | TTHA-6H | g/L | | | 5 | | | | | | 5 | | | |
| | HEDTA-3H | g/L | | | | 10 | | | | | | 5 | | |
| | CyDTA-4H | g/L | | | | | 20 | | | | | | | |
| | EDTA-4H | g/L | | | | | | 60 | | | | | 5 | |
| | EDTMP-8H | g/L | | | | | | | 10 | | | | | 5 |
| Reducing Agent | Dimethylamine Borane | g/L | 1 | 1 | 1 | 1 | 1 | 1 | 1 | 0.2 | 5 | 15 | | |
| | Trimethylamine Borane | g/L | | | | | | | | | | | 1 | |
| | Morpholine Borane | g/L | | | | | | | | | | | | 1 |
| | Sodium Hypophosphite | g/L | | | | | | | | | | | | |
| pH Adjuster | Sodium Hydroxide | g/L | | | | | | | | | | | | |
| | Potassium Hydroxide | g/L | | | | | | | | | | | | |

TABLE 4-continued

| | | | Plating Bath Composition Examples | | | | | | | | | | | |
|---|---|---|---|---|---|---|---|---|---|---|---|---|---|---|
| | | | 18 | 19 | 20 | 21 | 22 | 23 | 24 | 25 | 26 | 27 | 28 | 29 |
| | Tetramethyl Ammonium Hydroxide Solution (25%) | mL/L | 140 | 150 | 170 | 170 | 200 | 280 | 170 | 170 | 170 | 170 | 170 | 170 |
| Deposition Rate Controlling Agent | Maleic Acid | g/L | | 5 | | 5 | | 5 | | | 5 | | | |
| | 1,4-butynediol | ppm | | | | | | | | | | | | |
| | Itaconic Acid | g/L | 5 | | 5 | | 5 | | 5 | 5 | | 5 | 5 | 5 |
| | pH | | 13.3 | 13.3 | 13.3 | 13.3 | 13.3 | 13.3 | 13.3 | 13.3 | 13.3 | 13.3 | 13.3 | 13.3 |
| | Processing Temperature | | 80 | 80 | 80 | 80 | 80 | 80 | 80 | 80 | 80 | 80 | 80 | 80 |
| Evaluation | Film Thickness of Plating Film | nm | 65.2 | 98.3 | 85.2 | 98.5 | 76.2 | 32 | 65.3 | 63.1 | 95.1 | 75.1 | 92.1 | 94.3 |
| | Ruthenium Deposition Rate | nm/10 min | 65.2 | 98.3 | 85.2 | 98.5 | 76.2 | 82 | 65.3 | 63.1 | 95.1 | 75.1 | 92.1 | 94.3 |
| | Ruthenium Deposition Property | | ◎ | ◎ | ◎ | ◎ | ◎ | ◎ | ◎ | ◎ | ◎ | ◎ | ◎ | ◎ |
| | Stability of Plating Bath | | ○ | ◎ | ◎ | ◎ | ◎ | ◎ | ◎ | ◎ | ◎ | ◎ | ◎ | ◎ |
| | Resistivity of Plating Film after Annealing | μΩcm | 22.3 | 24.5 | 21 | 20.4 | 26.3 | 23.1 | 24.7 | 24.2 | 23.1 | 22.5 | 25.3 | 25.3 |

TABLE 5

| | | | Plating Bath Composition Examples | | | | | | | | | |
|---|---|---|---|---|---|---|---|---|---|---|---|---|
| | | | 30 | 31 | 32 | 33 | 34 | 35 | 36 | 37 | 38 | 39 |
| Ruthenium Salt | Ruthenium(IV) Chloride (as Ruthenium) | g/L | 1 | 1 | 1 | 1 | 1 | 1 | 1 | 1 | 1 | 1 |
| | Ruthenium(IV) Sulfate (as Ruthenium) | g/L | | | | | | | | | | |
| | Ruthenium(III) Nitrate (as Ruthenium) | g/L | | | | | | | | | | |
| | Ruthenium(III) Chloride (as Ruthenium) | g/L | | | | | | | | | | |
| Hydroxylamine Compound | Hydroxylamine Sulfate | g/L | 5 | 5 | 5 | 5 | 5 | 5 | 5 | 5 | 5 | 5 |
| | Hydroxylamine Chloride | g/L | | | | | | | | | | |
| Amine Compound | Glycine | g/L | | | | | | 2.5 | | | | |
| | Glycylglycine | g/L | 2.5 | | | | | | 2.5 | | | |
| | Na Aspartate | g/L | | 2.5 | | | | | | 2.5 | | |
| | Na Glutamate | g/L | | | 2.5 | | | | | | | |
| | L-arginine | g/L | | | | 2.5 | | | | | 2.5 | |
| | β-alanine | g/L | | | | | 2.5 | | | | | 2.5 |
| Deposition Rate Adjuster | DTPA-5H | g/L | 5 | | | | | | | 5 | | |
| | NTA-3H | g/L | | 5 | | | | | | | | |
| | TTHA-6H | g/L | | | 5 | | | | | | 5 | |
| | HEDTA-3H | g/L | | | | 5 | | | | | | 5 |
| | CyDTA-4H | g/L | | | | | 5 | | | | | |
| | EDTA-4H | g/L | | | | | | 5 | | | | |
| | EDTMP-8H | g/L | | | | | | | 5 | | | |
| Reducing Agent | Dimethylamine Borane | g/L | 1 | 1 | 1 | 1 | 1 | 1 | 1 | 1 | 1 | 1 |
| | Trimethylamine Borane | g/L | | | | | | | | | | |
| | Morpholine Borane | g/L | | | | | | | | | | |
| | Sodium Hypophosphite | g/L | | | | | | | | | | |
| pH Adjuster | Sodium Hydroxide | g/L | | 20 | | | | | | | | |
| | Potassium Hydroxide | g/L | 15 | | | | | | | | | |
| | Tetramethyl Ammonium Hydroxide Solution (25%) | mL/L | | | 170 | 170 | 170 | 170 | 170 | 170 | 170 | 170 |
| Deposition Rate Controlling Agent | Maleic Acid | g/L | 5 | | | | | | 5 | | 5 | |
| | 1,4-butynediol | ppm | | | | | | | | 1 | | |
| | Itaconic Acid | g/L | | 5 | | 1 | 2 | 10 | | | | 5 |
| | pH | | 13.3 | 13.3 | 13.3 | 3.3 | 13.3 | 13.3 | 13.3 | 13.3 | 10 | 11 |
| | Processing Temperature | | 80 | 80 | 80 | 80 | 80 | 80 | 80 | 80 | 80 | 80 |
| | Film Thickness of Plating Film | nm | 91.1 | 92.1 | 150 | 102 | 98.2 | 21.3 | 35.6 | 91.2 | 14.5 | 17.2 |
| | Ruthenium Deposition Rate | nm/10 min | 91.1 | 92.1 | 150 | 102 | 98.2 | 21.3 | 35.6 | 91.2 | 14.5 | 17.2 |
| | Ruthenium Deposition Property | | ◎ | ◎ | ◎ | ◎ | ◎ | ◎ | ◎ | ◎ | ○ | ○ |
| | Stability of Plating Bath | | ◎ | ◎ | ○ | ◎ | ◎ | ◎ | ◎ | ◎ | ◎ | ◎ |
| | Resistivity of Plating Film after Annealing | μΩcm | 22.1 | 25.4 | 24.2 | 21.5 | 22.1 | 23.6 | 21.1 | 22.4 | 25.1 | 21.1 |

TABLE 6

| | | | Plating Bath Composition Examples | | | | | | | | |
|---|---|---|---|---|---|---|---|---|---|---|---|
| | | | 40 | 41 | 42 | 43 | 44 | 45 | 46 | 47 | 48 |
| Ruthenium Salt | Ruthenium(IV) Chloride (as Ruthenium) | g/L | 1 | 1 | 1 | 1 | 1 | 1 | 1 | 1 | 1 |
| | Ruthenium(IV) Sulfate (as Ruthenium) | g/L | | | | | | | | | |
| | Ruthenium(III) Nitrate (as Ruthenium) | g/L | | | | | | | | | |
| | Ruthenium(III) Chloride (as Ruthenium) | g/L | | | | | | | | | |
| Hydroxylamine Compound | Hydroxylamine Sulfate | g/L | 5 | 5 | 5 | 5 | 5 | 5 | 5 | 5 | 5 |
| | Hydroxylamine Chloride | g/L | | | | | | | | | |
| Amine Compound | Glycine | g/L | 2.5 | | | | | | 2.5 | 2.5 | 2.5 |
| | Glycylglycine | g/L | | 2.5 | | | | | | | |
| | Na Aspartate | g/L | | | 2.5 | | | | | | |
| | Na Glutamate | g/L | | | | 2.5 | | | | | |
| | L-arginine | g/L | | | | | 2.5 | | | | |
| | β-alanine | g/L | | | | | | 2.5 | | | |
| Deposition Rate Adjuster | DTPA-5H | g/L | | | | 5 | | | | | |
| | NTA-3H | g/L | | | | | 5 | | | | |
| | TTHA-6H | g/L | | | | | | 5 | | 5 | 5 |
| | HEDTA-3H | g/L | | | | | | | 5 | | |
| | CyDTA-4H | g/L | 5 | | | | | | | | |
| | EDTA-4H | g/L | | 5 | | | | | | | |
| | EDTMP-8H | g/L | | | 5 | | | | | | |
| Reducing Agent | Dimethylamine Borane | g/L | 1 | 1 | 1 | 1 | 1 | 1 | 1 | | |
| | Trimethylamine Borane | g/L | | | | | | | | | |
| | Morpholine Borane | g/L | | | | | | | | | |
| | Sodium Hypophosphite | g/L | | | | | | | | 1 | 30 |
| pH Adjuster | Sodium Hydroxide | g/L | | | | | | | | | |
| | Potassium Hydroxide | g/L | | | | | | | | | |
| | Tetramethyl Ammonium Hydroxide Solution (25%) | mL/L | 170 | 170 | 170 | 170 | 170 | 170 | 170 | 170 | 170 |
| Deposition Rate Controlling Agent | Maleic Acid | g/L | 5 | | 5 | | 5 | | 5 | | |
| | 1,4-butynediol | ppm | | | | | | | | | |
| | Itaconic Acid | g/L | | 5 | | 5 | | 5 | | 5 | 5 |
| | pH | | 12 | 13 | 14 | 13.3 | 13.3 | 13.3 | 13.3 | 13.3 | 13.3 |
| | Processing Temperature | | 80 | 80 | 80 | 50 | 60 | 70 | 90 | 80 | 80 |
| Evaluation | Film Thickness of Plating Film | nm | 32.1 | 92.1 | 91.1 | 14.3 | 32.1 | 74.1 | 120.1 | 46.0 | 35.6 |
| | Ruthenium Deposition Rate | nm/10 min | 32.1 | 92.1 | 91.1 | 14.3 | 32.1 | 74.1 | 120.1 | 46.0 | 35.6 |
| | Ruthenium Deposition Property | | ◎ | ◎ | ◎ | ○ | ◎ | ◎ | ◎ | ◎ | ◎ |
| | Stability of Plating Bath | | ◎ | ◎ | ◎ | ◎ | ◎ | ◎ | ◎ | ◎ | ◎ |
| | Resistivity of Plating Film after Annealing | μΩcm | 22.4 | 22.1 | 23.1 | 23.1 | 24.5 | 22.6 | 24.2 | 58.5 | 54.0 |

TABLE 7

| | | | Plating Bath Composition Comparative Examples | | | | | | | | | |
|---|---|---|---|---|---|---|---|---|---|---|---|---|
| | | | 1 | 2 | 3 | 4 | 5 | 6 | 7 | 8 | 9 | 10 |
| Ruthenium Salt | Ruthenium(IV) Chloride (as Ruthenium) | g/L | 1 | 1 | 1 | 1 | 1 | 1 | 1 | 1 | 1 | 1 |
| | Ruthenium(IV) Sulfate (as Ruthenium) | g/L | | | | | | | | | | |
| | Ruthenium(III) Nitrate (as Ruthenium) | g/L | | | | | | | | | | |
| | Ruthenium(III) Chloride (as Ruthenium) | g/L | | | | | | | | | | |
| Hydroxylamine Compound | Hydroxylamine Sulfate | g/L | | | 5 | 5 | 5 | 5 | 5 | 5 | 5 | 5 |
| | Hydroxylamine Chloride | g/L | | | | | | | | | | |
| Amine Compound | Glycine | g/L | 2.5 | 2.5 | | | 2.5 | 2.5 | 2.5 | 2.5 | 2.5 | 2.5 |
| | Glycylglycine | g/L | | | | | | | | | | |
| | Na Aspartate | g/L | | | | | | | | | | |
| | Na Glutamate | g/L | | | | | | | | | | |
| | L-arginine | g/L | | | | | | | | | | |
| | β-alanine | g/L | | | | | | | | | | |
| Deposition Rate Adjuster | DTPA-5H | g/L | 5 | | 5 | | | | | | | |
| | NTA-3H | g/L | | | | | | | | | | |
| | TTHA-6H | g/L | | 5 | | 5 | 5 | 5 | 5 | 5 | 5 | 5 |
| | HEDTA-3H | g/L | | | | | | | | | | |
| | CyDTA-4H | g/L | | | | | | | | | | |
| | EDTA-4H | g/L | | | | | | | | | | |
| | EDTMP-8H | g/L | | | | | | | | | | |
| Reducing Agent | Dimethylamine Borane | g/L | 1 | 1 | 1 | 1 | | | | | | |
| | Trimethylamine Borane | g/L | | | | | | | | | | |
| | Morpholine Borane | g/L | | | | | | | | | | |
| | Sodium Hypophosphite | g/L | | | | | | | | | | |
| | Formic Acid (88%) | g/L | | | | | 5 | 10 | 20 | | | |
| | Hydrazine (80%) | g/L | | | | | | | | 1 | 5 | 10 |
| | Glyoxylic Acid (50%) | g/L | | | | | | | | | | |
| | Formalin (37%) | g/L | | | | | | | | | | |
| | Sodium Borohydride | g/L | | | | | | | | | | |

TABLE 7-continued

| | | | Plating Bath Composition Comparative Examples | | | | | | | | | |
|---|---|---|---|---|---|---|---|---|---|---|---|---|
| | | | 1 | 2 | 3 | 4 | 5 | 6 | 7 | 8 | 9 | 10 |
| pH Adjuster | Sodium Hydroxide | g/L | | | | | | | | | | |
| | Potassium Hydroxide | g/L | | | | | | | | | | |
| | Tetramethyl Ammonium Hydroxide Solution (25%) | mL/L | 170 | 170 | 170 | 170 | 200 | 250 | 300 | 170 | 170 | 160 |
| Deposition Rate Controlling Agent | Maleic Acid | g/L | 5 | | | | | | | | | |
| | 1,4-butynediol | ppm | | | | | | | | | | |
| | Itaconic Acid | g/L | | 5 | 5 | 5 | 5 | 5 | 5 | 5 | 5 | 5 |
| | pH | | 13.3 | 13.3 | 13.3 | 13.3 | 13.3 | 13.3 | 13.3 | 13.3 | 13.3 | 13.3 |
| | Processing Temperature | | 80 | 80 | 80 | 80 | 80 | 80 | 80 | 80 | 80 | 80 |
| Evaluation | Film Thickness of Plating Film | nm | 0 | 0 | 98.2 | 130.1 | 0 | 0 | 0 | 0 | 0 | 0 |
| | Ruthenium Deposition Rate | nm/10 min | 0 | 0 | 98.2 | 130.1 | 0 | 0 | 0 | 0 | 0 | 0 |
| | Ruthenium Deposition Property | | X | X | ◎ | ○ | X | X | X | X | X | X |
| | Stability of Plating Bath | | X | X | X | X | ◎ | ◎ | ◎ | ◎ | X | X |
| | Resistivity of Plating Film after Annealing | μΩcm | — | — | 25.2 | 23.1 | — | — | — | — | — | — |

TABLE 8

| | | | Plating Bath Composition Comparative Examples | | | | | | |
|---|---|---|---|---|---|---|---|---|---|
| | | | 11 | 12 | 13 | 14 | 15 | 16 | 17 |
| Ruthenium Salt | Ruthenium(IV) Chloride (as Ruthenium) | g/L | 1 | 1 | 1 | 1 | 1 | 1 | 1 |
| | Ruthenium(IV) Sul fate (as Ruthenium) | g/L | | | | | | | |
| | Ruthenium(III) Nitrate (as Ruthenium) | g/L | | | | | | | |
| | Ruthenium(III) Chloride (as Ruthenium) | g/L | | | | | | | |
| Hydroxylamine Compound | Hydroxylamine Sulfate | g/L | 5 | 5 | 5 | 5 | 5 | 5 | 5 |
| | Hydroxylamine Chloride | g/L | | | | | | | |
| Amine Compound | Glycine | g/L | 2.5 | 2.5 | 2.5 | 2.5 | 2.5 | 2.5 | 2.5 |
| | Glycylglycine | g/L | | | | | | | |
| | Na Aspartate | g/L | | | | | | | |
| | Na Glutamate | g/L | | | | | | | |
| | L-arginine | g/L | | | | | | | |
| | β-alanine | g/L | | | | | | | |
| Deposition Rate Adjuster | DTPA-5H | g/L | | | | | | | |
| | NTA-3H | g/L | | | | | | | |
| | TTHA-6H | g/L | 5 | 5 | 5 | 5 | 5 | 5 | 5 |
| | HEDTA-3H | g/L | | | | | | | |
| | CyDTA-4H | g/L | | | | | | | |
| | EDTA-4H | g/L | | | | | | | |
| | EDTMP-8H | g/L | | | | | | | |
| Reducing Agent | Dimethylamine Borane | g/L | | | | | | | |
| | Trimethylamine Borane | g/L | | | | | | | |
| | Morpholine Borane | g/L | | | | | | | |
| | Sodium Hypophosphite | g/L | | | | | | | |
| | Formic Acid (88%) | g/L | | | | | | | |
| | Hydrazine (80%) | g/L | | | | | | | |
| | Glyoxylic Acid (50%) | g/L | 1 | 5 | 10 | | | | |
| | Formalin (37%) | g/L | | | | 1 | 5 | 10 | |
| | Sodium Borohydride | g/L | | | | | | | 1 |
| pH Adjuster | Sodium Hydroxide | g/L | | | | | | | |
| | Potassium Hydroxide | g/L | | | | | | | |
| | Tetramethyl Ammonium Hydroxide Solution (25%) | mL/L | 170 | 200 | 230 | 170 | 170 | 170 | 170 |
| Deposition Rate Controlling Agent | Maleic Acid | g/L | | | | | | | |
| | 1,4-butynediol | ppm | | | | | | | |
| | Itaconic Acid | g/L | 5 | 5 | 5 | 5 | 5 | 5 | 5 |
| | pH | | 13.3 | 13.3 | 13.3 | 13.3 | 13.3 | 13.3 | 13.3 |
| | Processing Temperature | | 80 | 80 | 80 | 80 | 80 | 80 | 80 |
| Evaluation | Film Thickness of Plating Film | nm | 0 | 0 | 0 | 0 | 0 | 0 | 0 |
| | Ruthenium Deposition Rate | nm/10 min | 0 | 0 | 0 | 0 | 0 | 0 | 0 |
| | Ruthenium Deposition Property | | X | X | X | X | X | X | X |
| | Stability of Plating Bath | | ◎ | ◎ | ◎ | ◎ | ◎ | ◎ | X |
| | Resistivity of Plating Film after Annealing | μΩcm | — | — | — | — | — | — | — |

As can be seen from Tables 2 to 6, the electroless ruthenium plating baths of Examples 1 to 48 in which a hydroxylamine compound (at least one of hydroxylamine sulfate or hydroxylamine chloride) and an amine compound (at least one selected from the group consisting of glycine, glycylglycine, sodium aspartate, sodium glutamate, L-arginine, ß-alanine, serine, threonine, tyrosine, asparagine, glutamine, and lysine) are used in combination as a stabilizer can improve their bath stability and ruthenium deposition properties even if the electroless ruthenium plating baths contain an amine borane compound or sodium hypophosphite, which is a commonly used reducing agent.

As can be seen from Table 7, the electroless ruthenium plating baths of Comparative Examples 1 to 4 in which a hydroxylamine compound and an amine compound are not used in combination as a stabilizer have poor bath stability. In particular, the electroless ruthenium plating baths of Comparative Examples 1 and 2 containing no hydroxylamine compound have a poor ruthenium deposition property.

As can be seen from Tables 7 and 8, the electroless ruthenium plating baths of Comparative Examples 5 to 17 in which an amine borane compound or sodium hypophosphite is not used as a reducing agent have a poor ruthenium deposition property even through the electroless ruthenium plating baths contain a hydroxylamine compound and an amine compound in combination as a stabilizer.

The electroless ruthenium plating bath according to the present disclosure is suitably used particularly as a plating bath for forming a ruthenium plating film constituting: a wiring portion of a semiconductor circuit; a thin film (cap metal) formed on the copper wiring; or a liner film that is formed, in forming a copper wiring film by electroplating, on a barrier metal so that a copper seed film grow uniformly.

What is claimed is:

1. An electroless ruthenium plating bath at least comprising:

a ruthenium compound; a reducing agent; and a stabilizer, the reducing agent being at least one of an amine borane compound or sodium hypophosphite, the stabilizer being a combination of a hydroxylamine compound and an amine compound, the hydroxylamine compound being at least one of hydroxylamine sulfate or hydroxylamine chloride.

2. The electroless ruthenium plating bath of claim 1, wherein the amine compound is at least one selected from the group consisting of glycine, glycylglycine, sodium aspartate, sodium glutamate, L-arginine, β-alanine, serine, threonine, tyrosine, asparagine, glutamine, and lysine.

3. The electroless ruthenium plating bath of claim 1, wherein a concentration of the ruthenium compound is more than 0.01 g/L and 10 g/L or less, and a concentration of the reducing agent is from 0.2 g/L to 15 g/L inclusive.

4. The electroless ruthenium plating bath of claim 1, wherein a concentration of the hydroxylamine compound is from 1 g/L to 10 g/L inclusive, and a concentration of the amine compound is from 1 g/L to 15 g/L inclusive.

5. The electroless ruthenium plating bath of claim 1, further comprising a deposition rate adjuster.

6. The electroless ruthenium plating bath of claim 5, further comprising a deposition rate controlling agent.

* * * * *